US012692692B2

(12) United States Patent
Katajisto

(10) Patent No.: US 12,692,692 B2
(45) Date of Patent: Jul. 28, 2026

(54) RAIL STRUCTURE AND BALCONY COMPRISING THE RAIL STRUCTURE

(71) Applicant: INSINÖÖRITOIMISTO CM-RAKENTAJAT OY, Helsinki (FI)

(72) Inventor: Markku Katajisto, Helsinki (FI)

(73) Assignee: INSINÖÖRITOMISTO CM-RAKENTAJAT OY, Helsinki (FI)

( * ) Notice: Subject to any disclaimer, the term of this patent is extended or adjusted under 35 U.S.C. 154(b) by 592 days.

(21) Appl. No.: 18/001,275

(22) PCT Filed: Jun. 10, 2021

(86) PCT No.: PCT/FI2021/050435
§ 371 (c)(1),
(2) Date: Dec. 9, 2022

(87) PCT Pub. No.: WO2021/250328
PCT Pub. Date: Dec. 16, 2021

(65) Prior Publication Data

US 2023/0235547 A1 Jul. 27, 2023

(30) Foreign Application Priority Data

Jun. 12, 2020 (FI) ..... 20205617

(51) Int. Cl.
*E04B 1/00* (2006.01)
*E04F 11/18* (2006.01)

(52) U.S. Cl.
CPC ..... *E04B 1/003* (2013.01); *E04F 11/1853* (2013.01); *E04F 2011/1827* (2013.01)

(58) Field of Classification Search
CPC ..... E04F 11/1808; E04F 11/1817; E04F 11/1836; E04F 11/1851; E04F 11/1853; E04F 2011/1806; E04F 2011/1823; E04F 2011/1825; E04F 2011/1829; E04F 2011/1885; E04F 2011/1895; E04B 1/003
See application file for complete search history.

(56) References Cited

U.S. PATENT DOCUMENTS 3,593,963 A * 7/1971 Horgan, Jr. ..... E06B 3/5454 52/204.597
3,606,408 A * 9/1971 Wagner ..... E04F 11/1817 403/174

(Continued)

FOREIGN PATENT DOCUMENTS

AT 507317 A1 * 4/2010 ..... E04B 1/003
DE 2657600 A1 * 6/1978

(Continued)

*Primary Examiner* — Jonathan P Masinick
(74) *Attorney, Agent, or Firm* — Tarolli, Sundheim, Covell & Tummino LLP

(57) ABSTRACT

The object of the invention is a rail structure and a balcony, which comprise two or more rail sections (5, 6) at an angle with respect to each other, at least some of which rail sections (5, 6) comprise a top profile (5*a*, 6*a*) a bottom profile (5*b*, 6*b*) and a wall section (7) connecting them, which wall section is fastened at its bottom edge to the bottom profile (5*b*, 6*b*) and at its top edge to the top profile (5*a*, 6*a*). At least some of the rail sections (5, 6) are arranged to transmit a load exerted on themselves to the bottom profile of the rail section next to themselves via the wall section (7) of the rail section next to themselves.

11 Claims, 4 Drawing Sheets

(56) References Cited

Figure 1:
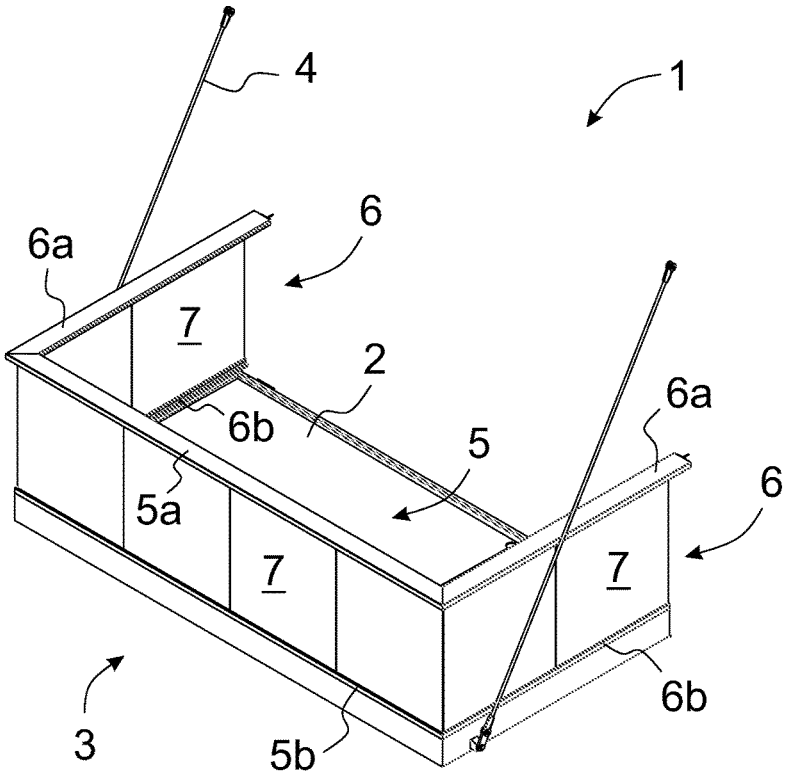

U.S. PATENT DOCUMENTS 3,991,877 A * 11/1976 Kraft ..... B66B 23/22 16/220
4,690,383 A * 9/1987 Batcheller ..... E04F 11/1853 256/73
4,841,697 A * 6/1989 Hogg ..... E04F 11/1853 52/208
7,559,536 B1 * 7/2009 Hansen ..... E04F 11/1851 256/25
7,866,636 B1 * 1/2011 Hansen ..... E04F 11/1851 256/65.14
8,167,274 B2 * 5/2012 Friese ..... E04F 11/1836 256/65.07
8,181,405 B2 * 5/2012 Nash ..... E04F 11/1851 52/800.18
9,366,382 B2 * 6/2016 Bonomi ..... E04F 11/1853
9,453,357 B1 * 9/2016 Bertato ..... E04C 2/46
9,617,736 B2 * 4/2017 Zhou ..... E04F 11/1812
9,657,760 B2 * 5/2017 Giacometti ..... F16B 5/0685
9,777,484 B2 * 10/2017 Header ..... E04F 11/1853
9,995,043 B2 * 6/2018 Bierman ..... E04F 11/1853
10,030,393 B2 * 7/2018 Spence ..... E04F 11/1812
11,459,766 B2 * 10/2022 Seeboth ..... E04F 11/1846
2011/0164408 A1 * 7/2011 Bol ..... B63B 17/04 427/256
2013/0055672 A1 * 3/2013 Tang ..... E04F 11/1836 52/716.2
2017/0218619 A1 * 8/2017 Lafontaine Berger .. E04B 1/003
2017/0292274 A1 * 10/2017 Downs ..... E04F 11/1853
2019/0301167 A1 * 10/2019 Tsukamoto ..... E04H 12/2253
2021/0246661 A1 * 8/2021 Chung ..... E04F 11/1808

FOREIGN PATENT DOCUMENTS

DE 102009008307 A1 * 10/2009 ..... E04F 11/1851
DE 102015216318 A1 * 3/2017
EP 3009580 A1 * 4/2016 ..... E04F 11/1812
EP 3892791 A1 * 10/2021 ..... E04F 11/1812
FI 12658 U 5/2020
FI 20185997 A1 5/2020
FR 1561354 A * 3/1969
FR 2136874 A1 * 12/1972
FR 2612543 A1 * 9/1988
FR 2807121 A1 * 10/2001 ..... E04F 11/181
FR 2930270 A1 * 10/2009 ..... E04F 11/1851
IT 201900002019 A1 8/2020
KR 100821337 B1 * 4/2008
KR 20140090436 A * 7/2014

* cited by examiner

RAIL STRUCTURE AND BALCONY COMPRISING THE RAIL STRUCTURE

The object of the invention is a rail structure as defined in the preamble of claim 1 and a balcony, comprising said rail structure, as defined in the preamble of claim 10.

The solution according to the present invention relates to a rail structure without a vertical pillar, and more particularly to the type of rail structure in which the end rails and front rails are plate-shaped structures, e.g. glass structures. Preferably the rail structure according to the invention can be used as a wall structure in the porches and balconies of buildings, which e.g. Finnish patent no. FI124759 represents as state-of-the-art, the contents of which patent can be regarded also as a part of the content of the present application.

A glass rail structure is per se known in the art, but generally such rail structures as are known in the art, and particularly balconies, usually comprise a vertical pillar intended to support the whole structure. Vertical pillars in transparent glass rail structures are, amongst other things, an aesthetic drawback.

Also known in the art are glass rail structures without vertical pillars. One such is presented in European patent application no. EP3179007 A1. This solution comprises an essentially high and solid bottom profile to which a thick two-layer glass panel is fastened with a so-called mast fixing. A thick glass panel enables the use of a glass panel of the height needed in the rail structure. According to the applicant, being also the manufacturer, the smallest glass thickness of the rail solution is 12.76 mm and the maximum height of the glass is 1200 mm. A problem in these types of glass rail solutions with no vertical pillar is, inter alia, precisely the thickness of the glass, which increases the weight of the glass and therefore causes problems handling the glass, and it is also a much worse option than thin glass in terms of environmental friendliness because e.g. more material is consumed and the transportation of it produces more emissions.

The aim of the present invention is to eliminate the aforementioned drawbacks and to provide an inexpensive and structurally strong rail structure in which a vertical pillar to support the rail structure is not needed. Another aim is to provide a balcony with a sturdy rail structure without a vertical pillar that could be e.g. aesthetically detrimental. The rail structure according to the invention is characterized by what is disclosed in the characterization part of claim 1. Correspondingly, the balcony according to the invention is characterized by what is disclosed in the characterization part of claim 10. Other embodiments of the invention are characterized by what is disclosed in the other claims.

The rail structure according to the invention comprises two or more rail sections at an angle with respect to each other, at least some of which rail sections comprise a top profile, a bottom profile and a wall section connecting them, which wall section is fastened at its bottom edge to the bottom profile and at its top edge to the top profile. Preferably at least some of the rail sections are arranged to transmit a load exerted on themselves to the bottom profile of the rail section next to themselves via the wall section of the rail section next to themselves.

The balcony according to the invention comprises a balcony slab as the load-bearing structure, which is fastened on its first side to e.g. the structures of the outer wall of a building, and which balcony comprises a rail structure comprising a plurality of rail sections, such as a front rail and end rail, provided with top profiles, bottom profiles and the wall sections between them, which end rail is fastened at its first end to e.g. the structures of the outer wall of a building, Preferably the rail sections are fastened to each other at their top profiles in such a way that the adjacent rail sections support each other.

In the balcony according to the invention the rail structure is implemented in such a way that a load, such as wind load, exerted on a rail is supported by means of the joints between the top and bottom profile of the rail and the wall section, such as glass, in the direction of the adjacent rail, and therefore in which case also in the direction of the wall section of the adjacent rail. The solution thus utilizes the capacity of the wall section to receive loads in its longitudinal direction.

Preferably the solution according to the invention is a glass-railed rail structure and balcony without a vertical pillar wherein the thickness of the glass used as a wall section can be as small as at most only approx. one one-hundredth of the height of the glass.

One major advantage of the rail structure according to the invention is that the solution allows thick, heavy—and therefore expensive—rail glass panels to be replaced with thinner and more lightweight glass. This enables easier, faster and safer installation of the rail structures. This also reduces the environmental impact because less raw material is used, and transportation costs also decrease because, inter alia, goods can be delivered to many sites with the same amount of fuel. The solution according to the invention enables a rail structure without a vertical pillar also when the end of the rail cannot be supported on a wall or on some other fixed support. In such a case the rail structure can be installed e.g. on a balcony in which the rail is on at least three sides, in other words on e.g. the front side and two end sides. This is possible because the rail loads, such as wind load, coming to the end rails can be supported by means of the joints between the top profile of the front rail and the wall section, such as a glass panel, in such a way that the capacity of the glass to receive loads in the direction of the rail section is utilized. In this case, one significant advantage is that glass panels of a thickness that is less than 1% of the height of the glass can be used in the wall sections.

Figure 2:
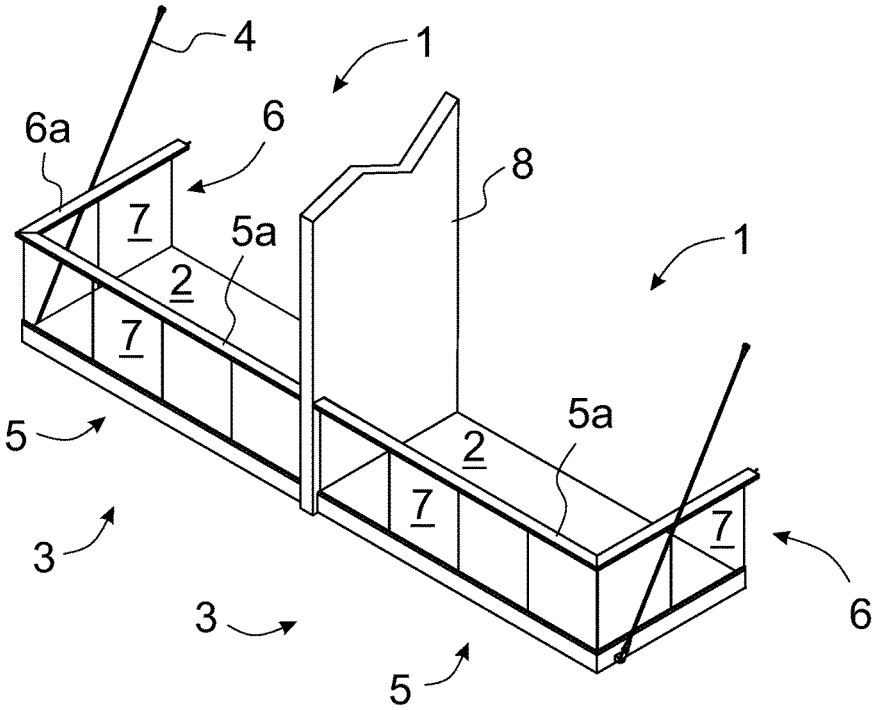
Figure 3:
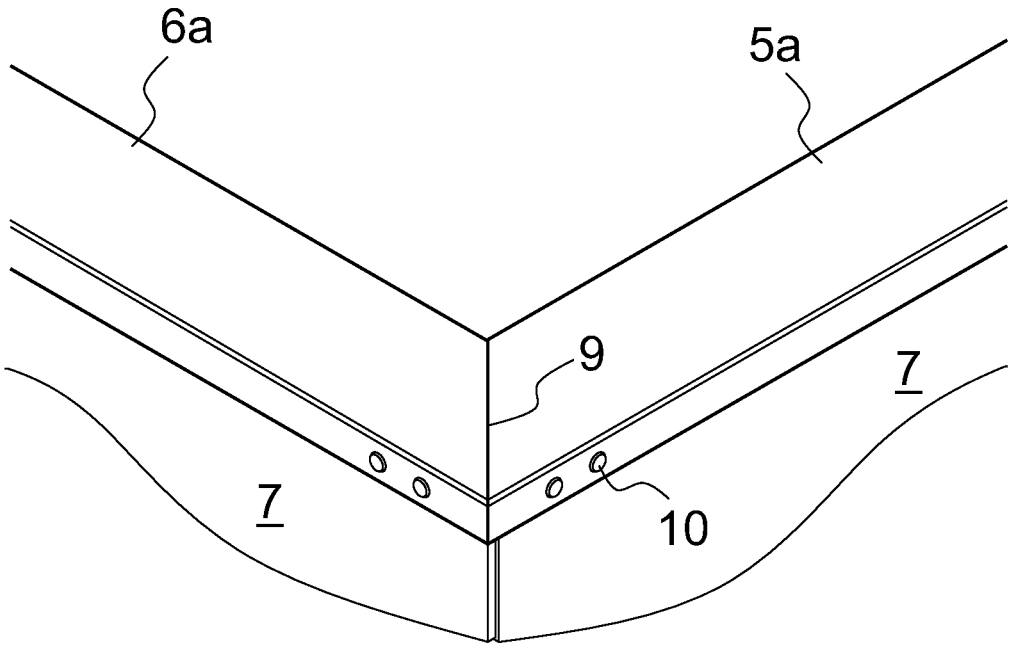
Figure 4:
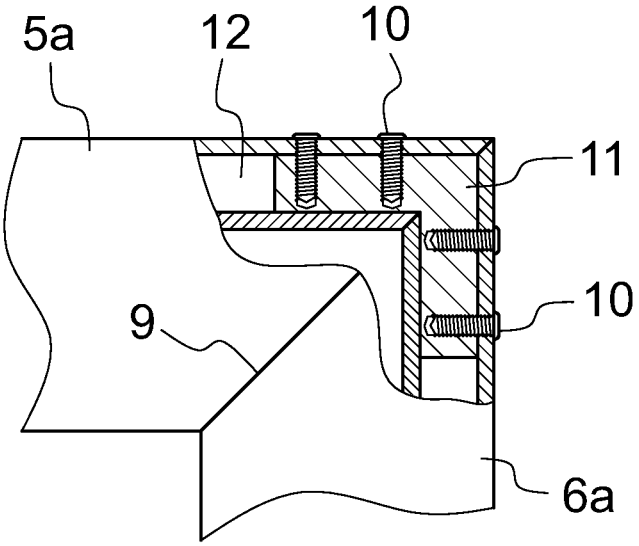
Figure 5:
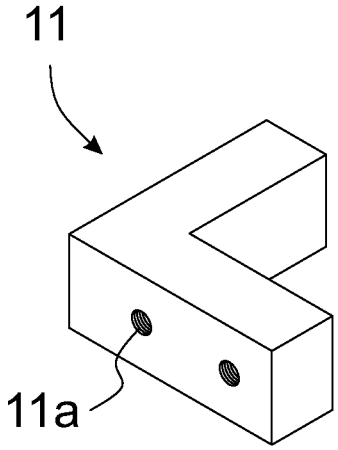
Figure 6:
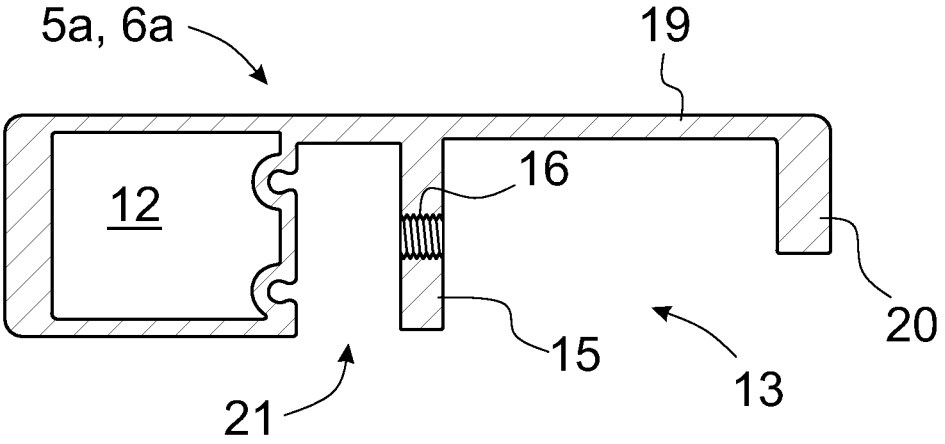
Figure 7:
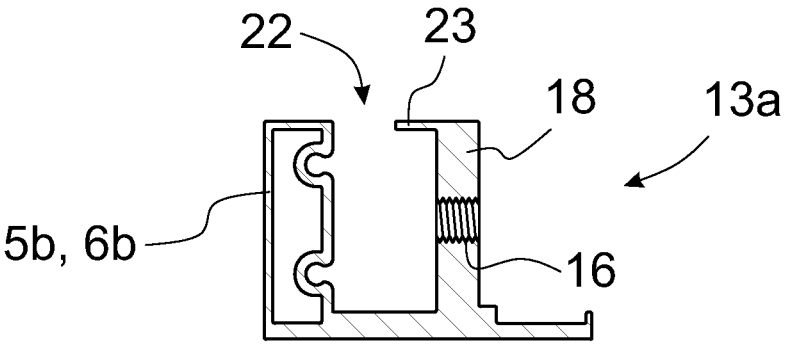
Figure 8:
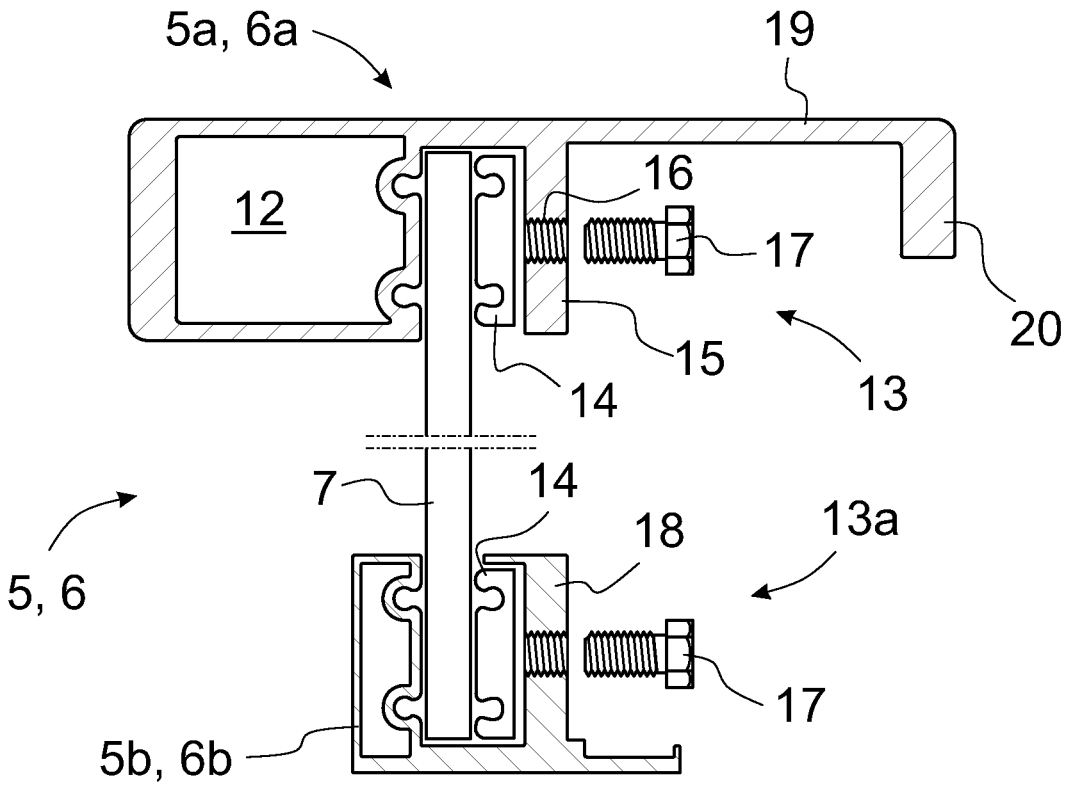
Figure 9:
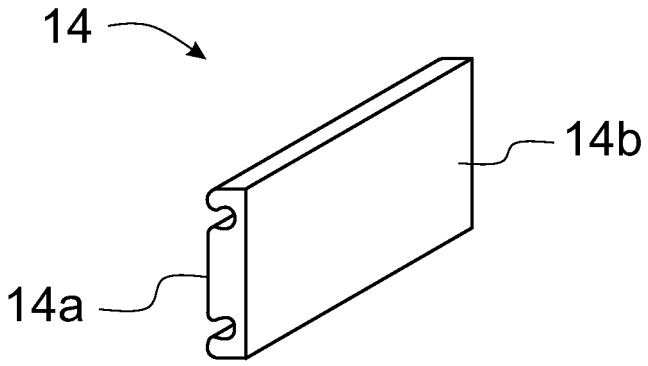

In the following, the invention will be described in more detail by the aid of some examples of its embodiment with reference to the attached drawings, wherein FIG. 1 presents one balcony solution according to the invention as viewed obliquely from the side and from above, in which solution a rail structure according to the invention is used, FIG. 2 presents another balcony solution according to the invention as viewed obliquely from the side and from above, in which solution a rail structure according to the invention is used, FIG. 3 presents one corner of the rail structure according to the invention as viewed obliquely from the side and from above, FIG. 4 presents one corner of the rail structure according to the invention as viewed from above when partially sectioned, FIG. 5 presents one support piece for the corner of the rail structure according to the invention as viewed obliquely from the side and from above, FIG. 6 presents an end view of one fastening mechanism for the top profile of the rail structure according to the invention, when sectioned at the point of the fixing hole, FIG. 7 presents an end view of one fastening mechanism for the bottom profile of the rail structure according to the invention, when sectioned at the point of the fixing hole, FIG. 8 presents an end view of one rail structure according to the invention at the point of the fastening mechanism, when partially sectioned, and FIG. 9 presents one fastening piece of the fastening mechanism used in the rail structure according to the invention as viewed obliquely from the side and from above.

The structures in the figures are simplified for the sake of clarity, and the figures are not necessarily drawn to the correct scale.

FIG. 1 presents a typical balcony solution according to the invention, i.e. a balcony 1, wherein the load-bearing structure can be a ferroconcrete flat slab functioning as the balcony slab 2, which is fastened at its first side to e.g. the structures of the outer wall of a building and supported e.g. by tie rods functioning as support structures 4 on both sides of the balcony 1. In addition to tie rods, e.g. pillars or cantilever beams, or a combination of them, can also be used as balcony support structures. In addition, the balcony comprises at least a rail structure 3 comprising a plurality of rail sections, such as a front rail 5 and an end rail 6 at each end of the balcony 1. The end rails 6 are fastened at their first ends to e.g. the structures of the outer wall of a building and at their second ends to the front rail 5.

Preferably the front rail 5 and end rails 6 are essentially similar in structure. The front rail 5 comprises a top profile 5*a* and a bottom profile 5*b* as well as an essentially vertical wall section 7, which is preferably e.g. glass, in connection with them and connecting them. Preferably a wall section 7 is comprised of one or more glass panels abutting each other, the bottom end of which panels is fastened to the bottom profile 5*b* and to the top part of which panels a top profile 5*a* is fastened. The bottom profile 5*b* is immovably fastened to the balcony slab 2, e.g. to the frame of the balcony slab 2, which is not presented in more detail in the figures.

Correspondingly, the end rail 6 comprises a top profile 6*a* functioning as a handrail and a bottom profile 6*b* as well as an essentially vertical wall section 7, which is preferably e.g. glass, between them and connecting them. Preferably a wall section 7 is comprised of one or more glass panels abutting each other, the bottom end of which panels is fastened to the bottom profile 6*b* and to the top part of which panels a top profile 6*a* is fastened. In this case also the bottom profile 6*b* is immovably fastened to the balcony slab 2, e.g. to the frame of the balcony slab 2.

Preferably the wall sections 7 in the rail structure 3 are laminated glass, in which are at least two layers of glass and a plastic layer between them. The glass can also be tempered glass. Typically a wall section 7 can in this case be comprised of a glass structure in which are two 4 mm glass panels and a thin plastic layer between them. In such a case, the total thickness of the glass is slightly over 8 mm. The wall section 7 can also be comprised of a glass structure having two 5 mm glass panels and a thin plastic layer between them, or of two 6 mm glass panels and a thin plastic layer between them. Furthermore, the second glass layer can be thinner than the other, e.g. 4+5 mm, 4+6 mm or 5+6 mm.

FIG. 2 presents another balcony solution according to the invention as viewed obliquely from the side and from above, in which solution a rail structure 3 according to the invention is used. In this solution each balcony 1 has a front rail 5 and only one end rail 6. The front rail 5 is fastened at its first end to the dividing wall 8 between the balconies 1 and at its second end to the end rail 6. Otherwise the balcony structure itself and the rail structure 3, together with its top profiles 5*a*, 6*a*, its bottom profiles 5*b*, 6*b* and the wall sections 7, are essentially similar to what is presented in the preceding in the description of the structure according to FIG. 1. Instead of the dividing wall 8 between balconies, a balcony 1 can be fastened to a balcony sidewall.

FIGS. 3-5 present one embodiment of a corner joint 9 at the corner of the front rail 5 and the end rail 6. The joint 9 in FIG. 3 is presented as viewed obliquely from the side and from above. FIG. 4 presents the same joint 9 as viewed directly from the end when partially sectioned, and FIG. 5 presents the joint piece 11 to be used in said joint 9 as viewed obliquely from the side and from above.

In the balcony 1 according to the embodiment, the top profile 6*a* of the end rail 6 and the top profile 5*a* of the front rail 5 are joined to each other with an essentially strong joint 9, such as a reinforced mitre joint. When the balcony 1 is rectangular, the ends of the top profiles 5*a* and 6*a* to be fitted against each other are cut to an angle of 45 degrees and placed against each other and also fastened to each other by the aid of fastening means 10, such as screws or rivets. Preferably the joint 9 is reinforced with a joint piece 11, which is disposed in a preferably hollow space 12 inside the top profiles 5*a* and 6*a*, which space is e.g. the length of the whole profile. In FIG. 4 the joint piece 11 is seen in the spaces 12 of the top profiles 5*a* and 6*a* in such a way that the top surface of the top profiles 5*a* and 6*a* is partly removed in FIG. 4.

The joint piece 11 has two prongs of preferably rectangular cross-section that are against each other at a right angle. When viewed from the top, the joint piece 11 can be L-shaped with sides of equal length, but the prongs can also be of different lengths. Preferably the joint piece 11 is dimensioned in such a way that it fits into the space 12 with essentially no free play. Additionally, in the joint piece 11 there are preferably fixing holes 11*a* for the fastening means 10.

The joint piece 11 is fitted into position by pushing the first prong of the joint piece 11 e.g. into the hollow space 12 of the top profile of the front rail 5 from the end of the top profile 5*a* cut at an angle of 45 degrees, in which case the second prong of the joint piece 11 is left pointing in the direction of the end rail 6 to be connected to it. When the top profile 6*a* of the end rail 6 is pushed from the end cut at an angle of 45 degrees into contact with the top profile 5*a* of the front rail, the second prong of the joint piece 11 is at the same time pushed into the hollow space 12 of the top profile 6*a*. When the fastening means 10 is fastened into position, the study mitre joint is completed. The joint piece 11 can be disposed in the top profile 5*a*, 6*a* elsewhere than in the hollow space 12, e.g. on the inside of the inner edge of the top profile as explained hereinafter.

FIGS. 6 and 7 present an end view of one top profile 5*a*, 6*a* and bottom profile 5*b*, 6*b* of the rail structure according to the invention, when sectioned at the point of the fixing hole of the fastening mechanism of the wall section 7. FIG. 6 presents the top profile 5*a*, 6*a* and FIG. 7 the bottom profile 5*b*, 6*b*.

The top profile 5*a*, 6*a* presented in FIG. 6 is essentially wide because it is intended to receive a force exerted on it from the top profile of the adjacent rail connected to it. The top profile 5*a*, 6*a* has a top wall 19, the width of the profile, forming an essentially flat top surface, at the front edge of which, below the top wall 19, is the aforementioned hollow space 12, which is essentially the length of the top profile, for, inter alia, the joint piece 11. Furthermore, beside the hollow space 12, towards the rear edge of the top profile i.e. in the direction of the rear edge, is a longitudinal groove-shaped space 21 essentially the length of the top profile and pointing downwards, for the wall section 7, e.g. for a glass panel, which space is bounded by a longitudinal wall 15 essentially the length of the top profile extending downwards that is, together with its threaded holes 16, a part of the fastening mechanism 13 for the wall section 7, said part being integrated into the top profile 5*a*, 6*a*. In this case the groove-shaped space 21, i.e. more briefly the fastening groove 21, is integrated into the top profile 5*a*, 6*a* and is thus a fixed part of the top profile 5*a*, 6*a*. The width of the fastening groove 21 extends from the rear wall of the hollow space 12 towards the rear edge of the top profile 5*a*, 6*a* to the wall 15, and the height extends preferably from the bottom surface of the top wall 19 to the bottom edge of the wall 15.

Towards the rear edge of the top profile from the wall 15, the top profile can have different profile elements with different intended purposes. On the rear edge, i.e. the inner edge, of the top profile 5*a*, 6*a* is a wall 20 extending downwards that functions as a part of the reinforcing structure of the top profile 5*a*, 6*a*. The aforementioned joint piece 11 can also be disposed on inside of the wall 20, instead of or in addition to the hollow space 12, to reinforce the joint between the top profiles 5*a*, 6*a*.

Correspondingly, the bottom profile 5*b*, 6*b* is an essentially lightweight profile having a front wall in an essentially vertical attitude and a base part at a right angle to it. In addition, in the bottom profile 5*b*, 6*b* is a longitudinal groove-shaped space 22 at least essentially the length of the bottom profile and pointing upwards, corresponding to the space 21 of the top profile, for fastening the wall section 7, e.g. a glass panel, the width of which space 22 is bounded by a longitudinal wall 18 essentially the length of the bottom profile extending upwards that is, together with its threaded holes 16, a part of the fastening mechanism 13*a* for the wall section 7, said part being integrated into the bottom profile 5*b*, 6*b*. In this case the groove-shaped space 22, i.e. more briefly the fastening groove 22, is integrated into the bottom profile 5*b*, 6*b* and is thus a fixed part of the bottom profile 5*b*, 6*b*. The width and height of the fastening groove 22 of the bottom profile is preferably essentially similar to the corresponding dimensions of the fastening groove 21 of the top profile.

A longitudinal protective protrusion 23 essentially the length of the wall 18 extends from the top edge of the wall 18 in the direction of the front wall of the bottom profile and partially above the fastening groove 22, the free end of which protrusion extends essentially to, or close to, the inside surface of the wall section 7 to be placed into the fastening groove 22 and covers the gap between the wall section 7 and the wall 18, in which gap is a plurality of fastening pieces 14 pressing the wall section 7 into position.

Additionally, there are fixing points in the bottom profile 5*b*, 6*b*, such as fixing holes, for fastening the bottom profile immovably to the balcony structure.

FIGS. 8 and 9 present a rail structure according to the invention, which is essentially similar in both the front rail 5 and the end rail 6. The rail structure in FIG. 8 is presented as viewed from the end of the rail, when partially sectioned at the point of the fastening mechanism 13, 13*a* of the wall section and with the height of the wall section 7 shortened. FIG. 9 presents one fastening piece 14 of a fastening mechanism 13, 13*a* used in the rail structure according to the invention as viewed obliquely from the side and from above. There can be many different types of fastening mechanisms, however, so the fastening piece 14 and fastening mechanism presented in the figures are just one example of fastening mechanisms suitable for the rail arrangement.

For fastening the wall section 7, i.e. preferably a glass panel or an element corresponding to it, to the top profile 5*a*, 6*a* and to the bottom profile 5*b*, 6*b*, the rail structure 3 according to the invention comprises a preferred fastening mechanism in connection with the front rail 5 and end rail 6, which for illustrative purposes is presented as two separate fastening mechanisms, namely the fastening mechanism 13 of the top profile and the fastening mechanism 13*a* of the bottom profile, which can be similar in terms of their essential parts. The fastening mechanism 13, 13*a* comprises a plurality of fastening pieces 14 that are disposed in the top profile 5*a*, 6*a* in the same elongated space 21 as the top edge of the wall section 7 and in the bottom profile 5*b*, 6*b* in the same elongated space 22 as the bottom edge of the wall section 7.

By the aid of tightening means 17, such as tightening screws 16 to be screwed into the fastening groove 21, 22 through the walls 15 and 18 bounding the top edge and bottom edge of the wall section 7, the fastening pieces 14 are pressed against the top edge and the bottom edge of the wall section 7 with such a compression force that the wall section 7 is locked in position in the fastening grooves 21 and 22 and due to friction cannot move in relation to the top profile 5*a*, 6*a* or the bottom profile 5*b*, 6*b* in the longitudinal direction of these profiles.

Retention of the wall section 7 in its position in the fastening grooves 21, 22 can be further reinforced with friction pads, which can be disposed e.g. on the surface 14*a* of the fastening piece 14 on the wall section 7 side and also between the top edge of the wall section 7 and the top profile 5*a*, 6*a*, and/or between the bottom edge of the wall section 7 and the bottom profile 5*b*, 6*b*.

A strong clamping prevents movement of the wall section 7 in relation to the top profiles and bottom profiles in their longitudinal directions and thus enables the wall section 7 to transmit a force acting in its longitudinal direction from the top profiles 5*a*, 6*a* to the bottom profiles 5*b*, 6*b* and via the bottom profiles onwards to the balcony structure. An essentially thin wall section 7, such as e.g. a glass structure of less than 10 mm thickness, is able in this case to transmit even a large force in its longitudinal direction.

Owing to the length of the rail, there can be a number of wall sections 7 disposed consecutively end-to-end in the rails 5, 6. In such a case each wall section 7 is fastened to the top profile and bottom profile of the rail with at least one fastening piece 14.

As is clearly seen from FIG. 8, in this preferred embodiment the top edge of the wall section 7 is fastened to the top profile 5*a*, 6*a* supported by the wall 15 integrated into the top profile 5*a*, 6*a* wholly inside the cross-sectional area of the top profile. Correspondingly, the bottom edge of the wall section 7 is fastened to the bottom profile 5*b*, 6*b* supported by the wall 18 integrated into the bottom profile 5*b*, 6*b* wholly inside the cross-sectional area of the bottom profile. In this case no extra, separate fixing structures are required, which can, in addition, be aesthetically problematic and can also be a hindrance e.g. in cleaning the glass surfaces.

Preferably the fastening mechanism 13 of the top profile is essentially inside the top profile 5*a*, 6*a*, more precisely inside the height of the rectangular cross-sectional area of the top profile 5*a*, 6*a*, and the fastening mechanism 13*a* of the bottom profile is essentially inside the bottom profile 5*b*, 6*b*, more precisely inside the height of the rectangular cross-sectional area of the bottom profile 5*b*, 6*b*. In this case the fastening mechanism 13 of the top profile does not extend substantially below the top profile 5*a*, 6*a*, in other words preferably most of the fastening mechanism 13 of the top profile is inside the top profile 5*a*, 6*a*. Correspondingly, the fastening mechanism 13*a* of the bottom profile also does not extend to above the bottom profile 5*b*, 6*b*, in other words preferably most of the fastening mechanism 13*a* of the bottom profile is inside the bottom profile 5*b*, 6*b*.

One concept of the invention is the type of rail structure 3 presented above, wherein e.g. a force exerted on the front rail 5 and/or on the end rail 6, such as a wind load, can be transmitted via the top profiles 5*a* and 6*a* to a rail adjacent to the rail in essentially the longitudinal direction of the adjacent rail.

For example, when the end rail 6 is pressed against the front rail 5 owing to e.g. wind load, the top profile 6*a* of the end rail is pressed against the end of the top profile 5*a* of the front rail 5 and thus the end rail 6 is supported on the front rail via the top profiles 6*a* and 5*a*. The top profile 5*a* of the front rail 5 is immovably fastened with respect to the wall section 7 of the front rail 5, which wall section 7 is further immovably fastened with respect to the bottom profile 5*b* of the front rail 5, which in turn is itself fastened immovably with respect to the balcony structure, e.g. with respect to the balcony slab 2. In this case the front rail 5, together with its top profiles 5*a*, wall sections 7 and also its immobile bottom profiles 5*b*, functions as a stationary support for the end rail 6 and does not let it move from the effect of said wind load, or other force, in the longitudinal direction of the front rail 5.

Correspondingly, the end rail 6 functions as an immobile support for the front rail 5 and does not let it move in its longitudinal direction from the effect of a force acting on the front rail.

The same support effect operates also in the pull direction as well as the push direction. If some force presses e.g. the end rail 6 outwards, the longitudinally immobile front rail 5 with its top profile 5*a* does not let the end rail turn outwards because the top profile 6*a* of the end rail 6 is immovably fastened by means of the joint 9 to the end of the top profile 5*a* of the front rail 5. The same also applies to the front rail 5. If some force presses the front rail 5 inwards or outwards, the longitudinally immobile end rail 6 with its top profile 6*a* does not let the front rail 5 turn inwards or outwards because the top profile 6*a* of the end rail 6 is immovably fastened by means of the joint 9 to the end of the top profile 5*a* of the front rail 5.

In the rail structure 3 and balcony comprising the rail structure 3 according to the invention, a force being exerted on the top profile 5*a*, 6*a* in its longitudinal direction is arranged to be transmitted via the wall section 7, such as a glass panel, fastened to the top profile 5*a*, 6*a* to the bottom profile 5*b*, 6*b* in the longitudinal direction of the top profile. So that the force can be transmitted from the top profile 5*a*, 6*a* via the wall section 7 to the bottom profile 5*b*, 6*b*, the fastening of the wall section 7 to the top profile 5*a*, 6*a* and to the bottom profile 5*b*, 6*b* must be extremely strong and thus immobile. The screw fixing, implemented with tightening means 17, according to the invention is one fastening that enables a sufficiently strong compression fixing.

Since the force caused by a load exerted on the rails 5 and 6 can be received in the longitudinal direction of the adjacent rail, and for the whole longitudinal length of the adjacent rail, the wall section 7 of the rails 5 and 6 can be made essentially thin because even a wall section 7 essentially thin in its longitudinal direction is able to receive a force in its own direction. Thus, in the rail structure according to the invention a wall section 7 can be used, the thickness of which at its smallest can be less than 1% of the height of the wall section 7. In this case, e.g. the thickness of a wall section 7 one meter high can be only between 8-12 mm, i.e. between 0.8%-1.2%, suitably between 10-11 mm, i.e. between 1-1.1%, and preferably approx. 9 mm, i.e. approx. 0.9%. The thickness of a wall section 7 can in this case be e.g. 9±0.8 mm. In this way a lightweight wall section is enabled that is easy to handle, environmentally friendly and is nevertheless safe in use, which wall section can be disposed e.g. in the rail structure of a glass balcony without a vertical pillar.

It is obvious to the person skilled in the art that different embodiments of the invention are not limited to the examples described above, but that they may be varied within the scope of the claims presented below. Thus, for example, some other fastening method can be used for fastening a wall section, i.e. in practice usually a glass panel, to a top profile and bottom profile than the aforementioned fastening piece fixing in which a fastening piece is pressed by means of a screw against the top edge and bottom edge of a wall section, in which case the wall section remains stationary in relation to the top profile and bottom profile. Instead of this type of friction fastening, a wall section can be fastened to the top profile and bottom profile e.g. with glue or in other ways. Furthermore, the fastening can be done with screws or by means of some other type of shape-locking.

It is also obvious to the person skilled in the art that the profile shapes of the top profiles and bottom profiles are only examples that can be replaced also with some other types of profile shapes that realize the same inventive concept.

It is further obvious to the person skilled in the art that the balcony structure can be supported in its position also with other support structures than the aforementioned tie rods or strut ropes. In such a case the support structures can be pillars in connection with the wall of the building and/or standing out from the wall, or also various cantilever beams suited to the purpose. A combination of tie rods and pillars or cantilever beams can also be used as the support structure.

The invention claimed is:

1. A rail structure comprising two or more rail sections at an angle with respect to each other, at least some of which rail sections comprise a top profile functioning as a handrail and having an elongated space, a bottom profile with an elongated space and a wall section connecting them, wherein the wall section has a top part and a bottom edge;

the wall section is fastened immovably at its top part to the top profile with a top fastening mechanism and at its bottom edge immovably to the bottom profile with a bottom fastening mechanism;

for fastening the wall section, the fastening mechanisms comprise a plurality of discrete fastening pieces to be pressed against the wall section;

the fastening pieces are disposed in the top profile in the same elongated space as the top edge of the wall section and in the bottom profile in the same elongated space as the bottom edge of the wall section;

the fastening pieces are arranged to be pressed against the wall section with tightening means to clamp the wall section between the fastening pieces and the wall of the elongated space of the respective profile;

the wall section is thereby locked in position in the elongated spaces of the profiles such that longitudinal movement of the wall section in relation to the profiles is prevented; and the top profiles of two adjacent rail sections are fastened immovably with respect to each other with a joint comprising a reinforcing joint piece and are fastened to each other with the aid of fastening means.

2. The rail structure according to claim 1, wherein at least some of the rail sections are arranged to transmit a load exerted on themselves to the bottom profile of the rail section next to themselves via the wall section of the rail section next to themselves.

3. The rail structure according to claim 1, wherein the top fastening mechanism of the top profile is inside the top profile and the bottom fastening mechanism of the bottom profile is inside the bottom profile.

4. The rail structure according to claim 1, wherein the reinforcing joint piece is disposed in a hollow space inside the top profiles and/or inside of a wall of the top profiles, and is fastened into its position with the fastening means.

5. The rail structure according to claim 1, wherein a thickness of the wall section is approximately 0.8-1.2% of a height of the wall section.

6. The rail structure according to claim 1, wherein a thickness of the wall section is smaller than 10 mm.

7. The rail structure according to claim 1, wherein the wall section is glass, and in that the rail structure is a glass rail without a vertical pillar.

8. A balcony, comprising:

a balcony slab as a load-bearing structure, the balcony slab having a first side, which is fastened on its first side to structures of an outer wall of a building, and which balcony comprises a rail structure according to claim 1, the rail sections of the rail structure having first ends, one of the rail sections being fastened at its first end to the structures of the outer wall of the building, wherein the rail sections are fastened to each other at their top profiles, functioning as handrails, in such a way that the adjacent rail section supports the rail section fastened to it in its own longitudinal direction; and at least some of the rail sections are arranged to transmit a load exerted on themselves to the bottom profile of the rail section next to themselves via the wall section of the rail section next to themselves.

9. The balcony according to claim 8, wherein the fastening pieces are disposed in the top profile in the same elongated space as the top edge of the wall section and in the bottom profile in the same elongated space as the bottom edge of the wall section, and that the fastening pieces are arranged to be pressed against the wall section with tightening means.

10. The balcony according to claim 8 wherein the rail structure of the balcony is without a vertical pillar, and in that the wall sections of the rail sections of the balcony are glass, wherein a total thickness of the glass is approximately 0.8-1.2% of a height of the wall section.

11. The balcony according to claim 10, wherein the total thickness of the glass of the wall section is at most approximately 1% of the height of the glass of the wall section.

* * * * *